US006814758B1

(12) United States Patent
Pacifici et al.

(10) Patent No.: US 6,814,758 B1
(45) Date of Patent: Nov. 9, 2004

(54) PROCESS FOR PROTECTING DYED NYLON FIBERS FROM COLORANTS AND CHEMICAL AGENTS

(75) Inventors: Joseph A. Pacifici, Anderson, SC (US); Daniel G. Sims, Greer, SC (US)

(73) Assignee: Simco Holding Corporation, Greenville, SC (US)

( * ) Notice: Subject to any disclaimer, the term of this patent is extended or adjusted under 35 U.S.C. 154(b) by 95 days.

(21) Appl. No.: 10/128,733

(22) Filed: Apr. 22, 2002

Related U.S. Application Data

(60) Provisional application No. 60/286,247, filed on Apr. 26, 2001.

(51) Int. Cl.[7] ..... D06M 0/00

(52) U.S. Cl. ..... 8/115.51; 8/115.51; 8/115.54; 8/115.56; 8/115.6; 8/115.68

(58) Field of Search ..... 8/142, 115.6, 115.51, 8/115.68

(56) References Cited

U.S. PATENT DOCUMENTS

| | | | | |
|---|---|---|---|---|
| 4,822,373 A | | 4/1989 | Olson et al. | 8/115.6 |
| 4,875,901 A | | 10/1989 | Payet et al. | 8/115.56 |
| 4,937,123 A | | 6/1990 | Chang et al. | 428/96.8 |
| 4,940,757 A | * | 7/1990 | Moss, III et al. | 252/502 |
| 5,001,004 A | | 3/1991 | Fitzgerald et al. | 428/263 |
| 5,032,136 A | | 7/1991 | Fitzgerald et al. | 8/115.6 |
| 5,340,886 A | | 8/1994 | Hoyt et al. | 525/426 |
| 5,464,584 A | | 11/1995 | Yeh | 264/103 |
| 5,574,106 A | | 11/1996 | Allen | 525/183 |
| 5,834,088 A | | 11/1998 | Pechhold | 428/96 |
| 5,843,328 A | * | 12/1998 | Pacifici et al. | 252/8.62 |
| 5,952,409 A | | 9/1999 | Boardman et al. | 524/185 |
| 6,197,378 B1 | | 3/2001 | Clark et al. | 427/315 |
| 6,207,594 B1 | | 3/2001 | Elgarhy | 442/93 |
| 6,300,299 B1 | | 10/2001 | Murphy et al. | 510/278 |
| 6,334,877 B1 | | 1/2002 | Studholme | 8/115.56 |

FOREIGN PATENT DOCUMENTS

| | | | | |
|---|---|---|---|---|
| EP | WO 89/02949 | * | 4/1989 | D06M/15/41 |

* cited by examiner

*Primary Examiner*—Yogendra N. Gupta
*Assistant Examiner*—D. G. Hamlin
(74) *Attorney, Agent, or Firm*—Baker Donelson Bearman Caldwell & Berkowitz

(57) ABSTRACT

Nylon fibers are protected from colorant staining by treating them with at least 2% we/wt (weight dry SAC/weight dry nylon fiber) of sulfonated aromatic aldehyde condensation product. The treated fibers are then fixed by the wet heat method.

3 Claims, No Drawings

PROCESS FOR PROTECTING DYED NYLON FIBERS FROM COLORANTS AND CHEMICAL AGENTS

REFERENCE TO RELATED APPLICATION

This application is a continuation of provisional application Ser. No. 60/286,247 filed Apr. 26, 2001.

TECHNICAL FIELD

The present invention is directed to processes for protecting nylon fibers from staining due to colorants such as iodine found in betadine solution, and turmeric found in mustard products while also protecting nylon fiber dyes from fading due to reactive chemical agents such as sodium hypochlorite found in household bleach and bleach cleaners and benzoyl peroxide found in acne care products.

BACKGROUND OF THE INVENTION

In 1985 the carpet industry began using anionic (negative charged) polymers on acid dyeable nylon fibers to impart stain resistance (stainblocking) to carpets and rugs to protect them from colorant type stains. These stains are caused by dyes in food and drink products that come into contact with nylon fibers. These colorants have the ability to permanently dye the nylon fibers with the severity of the stain being dependent on the type and polymer structure of the fibers. Because acid dyeable nylon fibers are cationic (positive) charged fibers, they tend to stain easily when in contact with anionic (negative charged) colorants such as those in Kool Aid, wine and coffee. Cationic dyeable nylon fibers, however, are anionic (negative) charged fibers and have natural resistance to anionic colorant stains. Although cationic dyeable and stainblocked acid dyeable nylon fibers have negative charges, they both contain similar polymer structures (morphologies).

As a result of the natural stain resistance of cationic dyeable nylon type fibers, there has been an increase in their use over the years, particularly in commercial carpets used for schools, offices, healthcare facilities and in the food service industry. The method for coloration of the cationic dyeable nylon has mostly involved the use of solution dyed nylon fibers. These are dyed nylon fibers where the color (shade) is introduced as a pigment in the manufacturing process of the fibers. The advantage is that the dye pigments in the solution dyed fibers are resistant to fading from chemical agents; whereas, dyestuffs in acid dyed nylon fibers will fade.

A carpet mill dye process method to impart coloration to cationic dyeable nylon fibers (CD-nylon) is disclosed in U.S. Pat. No. 5,058,667. Although the dyes are not resistant to chemical agents by this method, color combinations far above that of solution dyed nylon can be achieved. Regardless of method of coloration, carpet products from both methods are stain resistant to anionic colorant type stain. Similar stain resistance (stainblocking) properties can be achieved using acid dyeable type nylons treated with sulfonated aromatic aldehyde condensation polymers (SAC) and methacrylate type anionic polymers to impart an anionic charge on the fibers similar to that of the cationic dyeable nylon type fibers. These polymers are disclosed in a number of patents such as in U.S. Pat. Nos. 4,822,373, 4,875;901, and 4,937,123. But whether the nylon fibers are naturally or chemically stain resistant, they are not protected against stains from iodine and turmeric (mustard); nor are the dyes on dyed nylon fibers protected against fading from reactive chemical agents contained in bleach and acne care products.

When nylon fibers have a negative charge, either naturally or from stainblocker treatments, there is a charge/charge repulsion between the colorant and the fiber surface. Therefore, an ionic charge repulsion mechanism prevents negatively charged colorants from diffusing to available free amine end groups (dye sites) that are contained in the nylon fibers. As a consequence, a colorant containing product that is spilled on a carpet can be removed by rinsing or extracting with water without leaving a stain. The mechanism by which dyestuffs on dyed nylon are faded by reactive chemical agents is somewhat more complex. Chemicals such as sodium hypochlorite in bleach, and benzoyl peroxide in acne care products, form highly reactive chemical species such as chlorine and benzoyl radical. These species react with organic molecules that surround them, especially those that contain highly unsaturated chemical bonds. Dyestuffs are organic molecules that contain highly conjugated unsaturated molecular arrays. The structure of these arrays account for what is observed as color. The reaction of dyes on nylon fibers with the reactive species in chemical agents destroys the chemical bonds which give dyes color. This decolorizing effect can visually appear as a shade loss, a bleaching effect, or sometimes as a different looking stain. Reactive chemical agents permanently damage dyes on carpet in those areas for which they are in contact.

Although cationic dyeable nylon and stainblocked acid dyeable nylon prevent staining from most colorant stains, they do not prevent stains from iodine in betadine solution or turmeric stains in mustard products. The reason is that colorants contained in betadine and mustard are neutrally charged and are unaffected by a charge/charge repulsion mechanism. As a consequence, these colorants readily diffuse into the nylon polymer structure causing a stain. There are, however, stain removal method such as that disclosed in U.S. Pat. No. 6,300,299 for mustard using peroxide and uv light and for betadine using household bleach solutions or bleach and bisulfite containing cleaning chemicals.

Ironically, recommended methods and cleaning agents for removing iodine and mustard stains can themselves damage dyes on acid dyed nylon fibers, therefore causing dye fading. Colorant pigments in solution dyed fibers are not effected by cleaning chemical products or benzoyl peroxide in acne care products. Unfortunately, many multicolored commercial carpet styles contain both acid dyed nylon fibers and solution dyed nylon fibers for color effects and styling. This tends to compound the problem when deciding which cleaning method and cleaner to use.

Accordingly, it is seen that a need has long remained for a process for protecting acid dyes from chemical agents and nylon fibers from neutrally charged colorants. It thus is the provision of such that this invention is primarily directed.

SUMMARY OF THE INVENTION

In a preferred form of the invention acid dyeable and cationic dyeable nylon fibrous products colored by either acid dyed (mill) processes, solution dyed (fiber) processes, or combinations thereof, are treated with a high level of sulfonated aromatic aldehyde condensation product (SAC) and then fixed by the wet heat method. By high level is meant at least 2% wt/wt (dry weight SAC/dry weight nylon fiber). So treated, the nylon fibers in dyed nylon are protected from staining by neutrally charged colorants and the dyes in the dyed nylon are protected from fading by chemical agents.

The reason for this phenomenon is not clear. High levels of methacrylate type stainblockers are totally ineffective in blocking neutrally charged colorants and chemical agents. Even the application of high levels of SAC are ineffective if fixed by the dry heat method. Apparently this new two step process closes the crystalline structure of the nylon fibers, a phenomenon previously observed in U.S. Pat. No. 5,350,426 which utilized a dry heat set method. In any event the process does render the dyed nylon fibers resistant to staining and chemical agents. Effective SAC anionic polymers are those described in *Textile Chemist & Colorist,* November 1989, Vol. 21, No. 11.

DETAILED DESCRIPTION

There are two well known fixation methods used to achieve stain resistance from colorant type stains in the industry. These are the dry heat method and the wet heat method. In the dry heat method an SAC product is applied using either spray or foam onto a carpet. The treated carpet is then heated and dried in a dryer range or oven. The heat fixes the SAC to the nylon fibers. The wet heat method is done in either of two ways. The first way, herein referred to as the wet heat steam method, involves applying the SAC as an aqueous mix to either carpet, carpet yarns, or nylon sock and steaming the goods for several minutes to fix the SAC to be fibers. The second way, herein referred to as the wet heat batch method, involves applying the SAC to a treatment bath, then submerging the carpet, carpet yarns or carpet fibers into the bath. The bath is heated to elevated temperatures and held for several minutes to fix the SAC to the nylon fibers.

Both the dry and wet heat application methods are predominately done in the carpet industry for stainblocking on acid dyeable nylon fibers. Cationic dyeable nylon fibers are already naturally stain resistant. Therefore, this treatment is not required. Since colorants contained in betadine and mustard stain by a different mechanism, because of their neutral charge, both types of nylon fibers must be treated to effect stain resistance. In addition they must be treated by a wet heat fixation. The dry heat process does not work. Conventional methods of stainblocking with SAC and methacrylates are sufficient for preventing colorant type stains from products such as Kool Aid, wine and coffee, but they do little to prevent staining from neutrally charged colorants or to prevent dye fading from chemical agents.

EXAMPLE 1

Carpet samples: Four nylon sample sets were treated. Sample set 1 was an acid dyed cationic dyeable T-66 nylon sock. Sample set 2 was a solution dyed cationic dyeable T-66 nylon carpet. Sample set 3 was an acid dyeable T-6 nylon carpet. Sample set 4 was a blend of acid dyed T-66 and solution dyed T-6 acid dyeable nylon carpet. The SAC used was SIMCOFIX N-201A. This is a 30% solids product sold by SIMCO PRODUCTS INC. of P. O. Box 17903, Greenville, S.C. It is also referred to as a sulfonated novolac type anionic polymer. The SAC chemistry is used for both stainblocking and colorfastness.

The method for testing iodine stain resistance was a modified version of AATCC Test Method 175. The only difference was that betadine solution, which contains about 1% iodine, was used to replace the red dye 40 test solution. Approximately 20 ml was used.

Both the dry heat and wet heat methods were used to fix the SAC to the nylon fibers. In the dry heat method samples were treated with an aqueous solution of N-201A (pH=4.5) using a sprayer at a level of 100% wet add-on. The samples were then dried in a small drying oven to fix the SAC. In the wet heat method one sample group from the sets were treated with N-201A (pH=4.5) at a 200% wet add-on level by padding on the finish. These samples were then steamed in a small steamer for five minutes to fix the SAC. Another sample group from the sets was submerged in a water bath that contained the N-201A (pH 4.5) product. The bath was heated to 180° F. and held for 20 minutes to fix the SAC. Although all treatment solutions were adjusted to a pH of 4.5, the pH range that could be used in this experiment is between 1–7. The optimum treatment level based On Weight of Fiber (%OWF) can vary depending on the fiber type. The optimum range is from 8–16% OWF of N-201A (30%) for most nylon fibers. This amounts to about 2–4% wt/wt (weight dry SAC/weight dry nylon fiber. The results are shown in Table 1.

TABLE 1

| | Ratings | | | |
|---|---|---|---|---|
| Sample Set | Control Untreated | Dry Heat | Wet Heat Stream | Wet Heat Batch |
| 1 | 1 | 3 | 8 | 9 |
| 2 | 1 | 2 | 8 | 9 |
| 3 | 1 | 3 | 9 | 10 |
| 4 | 1 | 2 | 7 | 9 |

Here 1 is severe staining and 10 is no staining. 7 or above is acceptable. All test samples were treated at 12% OWF with N-201A.

EXAMPLE 2

This test was to determine if methacrylate type stainblockers could also impart iodine resistance to nylon fibers. Sample sets 1 and 2 above were used for testing. Methacrylate stainblockers, 668F from 3M and Eronial NYB from CIBA Specialty Chem. Co. and SIMCOFIX N-201A (pH=4.5) from Simco Products were tested as the SAC product. All test samples were treated at a level of 12% OWF and fixed by the Wet Heat Batch method. The results are shown in Table 2 where the numbers indicate the same as in Table 1.

TABLE 2

| Sample Set | Control Untreated | N-201A | 668F | NYB |
|---|---|---|---|---|
| 1 | 1 | 9 | 2 | 1 |
| 2 | 1 | 9 | 2 | 1 |

EXAMPLE 3

Fourteen carpet samples from eight manufacturers were obtained to test for betadine resistance using the Wet Heat Batch method to fix the SAC. All test samples wee treated at 15% OWF using SIMCOFIX-201A (pH+4.5) as the SAC. In addition, two of the acid dyed samples were tested for bleach resistance. The following describes nylon type and manufacturer.

| Sample | Manufacturer | Carpet Specification |
|---|---|---|
| a | Shaw | T-6 solution dyed acid dyeable nylon |
| b | Shaw | T-66 solution dyed cationic dyeable nylon |
| c | Queen | Acid dyed acid dyeable nylon |
| d | Queen | Acid dyed and solution dye nylon blend |

-continued

| Sample | Manufacturer | Carpet Specification |
|---|---|---|
| e | Bolyu | T-66 solution-dyed cationic dyeable nylon |
| f | C&A | Acid dyed and solution dyed nylon blend |
| g | Monterey | T-6 acid dyed acid dyeable nylon |
| h | Mohawk | T-6 acid dyed acid dyeable nylon |
| i | Mohawk | T-6 acid dyed acid dyeable nylon |
| j | Mohawk | T-6 acid dyed acid dyeable nylon |
| k | Burlington | T-66 solution dyed cationic dyeable nylon |
| l | Burlington | T-66 acid dyed cationic dyeable nylon |
| m | Burlington | T-66 acid dyed cationic dyeable nylon |
| n | J&J | Acid dyed and solution dyed nylon blend |

The results for betadine resistance are shown in Table 3 and bleach resistance in Table 4.

Betadine Test

TABLE 3

| Sample | Control (untreated) | Wet Heat Batch |
|---|---|---|
| a | 1 | 10 |
| b | 1 | 10 |
| c | 1 | 10 |
| d | 1 | 10 |
| e | 1 | 10 |
| f | 1 | 10 |
| g | 1 | 10 |
| h | 1 | 6 |
| i | 1 | 7 |
| j | 1 | 7 |
| k | 1 | 10 |
| l | 1 | 10 |
| m | 1 | 10 |
| n | 1 | 10 |

Bleach Test

TABLE 4

| Sample | Control | Wet Heat Batch |
|---|---|---|
| c | poor | excellent |
| l | poor | excellent |

The test method was the same as AATCC TM 175 except household bleach at 100% strength was used instead of red dye 40 solution. The bleach resistance of the dyes to fading were rated poor, fair, good, or excellent.

EXAMPLE 4

Samples from a, b, and c from Table 3 were tested for betadine resistance using the following SAC polymers: N-201A from Simco Products, TN-16 from Nicca USA, Erional NW from CIBA, Nylan Fixan P from Clariant, and Mesitol NBS from Mobay. All samples were treated at 15% OWF and fixed by wet heat batch method. All samples were adjusted to pH 4.5. The results are shown in Table 5.

TABLE 5

| | Samples | | |
|---|---|---|---|
| Product | a | b | c |
| N201A | 10 | 9 | 10 |
| TN-16 | 9 | 8 | 8 |
| NW | 8 | 7 | 9 |

TABLE 5-continued

| | Samples | | |
|---|---|---|---|
| Product | a | b | c |
| Fixan P | 7 | 6 | 7 |
| Mesitol | 9 | 9 | 8 |

EXAMPLE 5

Four sample sets of a multi-colored carpet were studied for stain resistance to iodine found in betadine, turmeric found in mustard, chlorine found in household bleach solutions, and benzoyl peroxide found in acne treatment products. The multicolored carpet contained both solution dyed cationic dyeable nylon fibers and acid dyed acid dyeable nylon fibers. Both types of fiber were type 66 nylon from DuPont.

The test samples in the sets were treated by a wet heat batch method at 9, 12 and 15% OWF with N-201A (pH= 4.5). The treatment chemicals were placed on the carpet. About 20 ml of betadine and household bleach were added into a 2 inch diameter ring. About 20 grams of mustard and a maximum strength acne wash (OXY-10, 10% benzoyl peroxide) were placed on the carpet samples and massaged into the carpet pile. All treated samples were left for 24 hours, then rinsed with water, dried, and evaluated for results. All test products were used without dilution.

Two methods were used to assign the results. Since betadine and mustard impart color to carpet, they were rated by the AATCC Test method 175 with 1 being severe staining and 10 being no staining. Since household bleach and benzoyl peroxide destroy dyes causing fading, these samples were rated by the AATCC grey scale for dye fade where 1 represented severe fading and 5 represented no fading.

TABLE 6

| | | % OWF | | |
|---|---|---|---|---|
| Test Method/Test Product | Control | 9 | 12 | 15 |
| TM 175 | | | | |
| Betadine | 1 | 7 | 9 | 10 |
| Mustard | 1 | 9 | 10 | 10 |
| Grey Scale | | | | |
| Bleach | 1 | 3–4 | 4 | 4 |
| Benzoyl Peroxide | 1 | 5 | 5 | 5 |

TM 175: 1 = severe stain; 10 = no stain. 8 or above is acceptable
Grey scale: 1 = severe fade; 5 = no fade. 3–4 or above is acceptable In this multicolored carpet especially untreated control samples those fibers that were dyed with acid dyestuffs were affected by the test product and showed fading. Colorant pigments contained in the solution dyed yarns of the carpet are expected not to fade and they showed no fading. The grey scale evaluation centered only on fading in the acid dyed yarns.

EXPERIMENT 6

Treated and untreated samples from Table 3, example 3, were tested for stain resistance against colorants contained in mustard. Samples were a, b, c, d, f, k, l, and n. The method of application, chemical and mustard resistance testing was the same as in Example 5. The results are shown in Table 7.

TABLE 7

| Sample Table 3 | Control | Treated |
|---|---|---|
| a | 1 | 10 |
| b | 1 | 10 |
| c | 1 | 10 |
| d | 1 | 10 |
| f | 1 | 10 |
| k | 1 | 10 |
| l | 1 | 10 |
| n | 1 | 10 |

This new process thus provides two general types of protection to dyed nylon fibrous products. The first type of protection involves preventing colorants such as those contained in betadine solution or turmeric (mustard) products from permanently staining the nylon fibers. The second type of protection involves preventing reactive chemical agents contained in chlorine bleach products or acne care products from reacting with, therefore permanently fading, dyestuffs on nylon fibers dyed with acid dyes. It is theorized that the SAC polymers chemically reduce the permeability of the nylon surface structure (surface morphology) to penetration from neutrally charged colorants and reactive chemical agents by a cross-linking mechanism. Since the polymer structure of nylon fibers for carpet products must be open (porous) for dyes to penetrate or diffuse into the fibers in the dyeing processes, then it is reasonable to assume that colorants and chemical agents also penetrate the fibers in the same manner. Apparently, SAC polymers under wet heat conditions have the ability to effective form a cross-linked polymer matrix (spider web) over the openings of the porous structures of the fibers. As a consequence the fibers and dyes are protected from entry to colorants and reactive chemical agents. As to why methacrylate stainblocker polymers do not exhibit the same behavior as SAC polymers, we can only assume this is due to differences in charge density, molecular weight, and chemical structure between the two classes of polymers.

What is claimed is:

1. A process for providing acid dyable nylon fibers and cationic dyeable nylon fibers with stain resistance to neutral colorants, wherein the process comprises the steps of treating the nylon fibers with at least 2% wt/wt (weight dry SAC/weight dry nylon fiber) of sulfonated aromatic aldehyde condensation product and then fixing the treated nylon fibers by a wet heat method.

2. The process of claim 1 wherein the treated nylon fibers are selected from the group consisting of acid dyed acid dyeable nylon fibers, acid dyed cationic dyeable nylon fibers, solution dyed acid dyeable nylon fibers and solution dyed cationic dyeable nylon fibers.

3. A process for providing acid dyed acid dyeable nylon fiber and acid dyed cationic dyeable nylon fibers with resistance to chemical fading, wherein the process comprises the steps of treating the dyed nylon fibers with at least 2% wt/wt (weight dry SAC/weight dry nylon fiber) of sulfonated aromatic aldehyde condensation product and then fixing the treated nylon fibers by a wet heat method.

* * * * *